US005866506A

United States Patent [19]

Tutt et al.

[11] Patent Number: 5,866,506

[45] Date of Patent: Feb. 2, 1999

[54] ASSEMBLAGE AND PROCESS FOR THERMAL DYE TRANSFER

[75] Inventors: Lee W. Tutt, Webster; David L. Jeanmaire, Brockport, both of N.Y.

[73] Assignee: Eastman Kodak Company, Rochester, N.Y.

[21] Appl. No.: 882,507

[22] Filed: Jun. 25, 1997

[51] Int. Cl.[6] ..... B41M 5/035; B41M 5/38

[52] U.S. Cl. ..... 503/201; 503/204; 503/226; 503/227

[58] Field of Search ..... 503/200, 204, 503/226, 227, 201, 215; 8/471; 427/150–152; 428/195, 913, 914

[56] References Cited

U.S. PATENT DOCUMENTS 4,791,095 12/1988 Ikeda et al. ..... 503/209

FOREIGN PATENT DOCUMENTS 0 433 024 6/1991 European Pat. Off. ..... 503/218

*Primary Examiner*—Bruce H. Hess

*Attorney, Agent, or Firm*—Harold E. Cole

[57] ABSTRACT

This invention relates to a thermal dye transfer assemblage comprising:

I) a dye-donor element comprising a support having thereon a set of sequential repeating dye patches of two subtractive primary color image dyes dispersed in a polymeric binder; and II) a dye-receiving element comprising a support having thereon in order:

a) a layer comprising a heat-sensitive, dye-forming precursor of a third, complementary, subtractive primary color image dye dispersed in a polymeric binder, the dye-forming precursor being capable of forming the third, complementary, subtractive primary color image dye at a temperature which is higher than the temperature used to transfer the other two subtractive primary color image dyes; and b) a dye image-receiving layer; the dye-receiving element being in superposed relationship with the dye-donor element so that the dye layer is in contact with the dye image-receiving layer.

11 Claims, No Drawings

ASSEMBLAGE AND PROCESS FOR THERMAL DYE TRANSFER

FIELD OF THE INVENTION

This invention relates to an assemblage and process for obtaining a fall color image using a thermal dye transfer process.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

DESCRIPTION OF RELATED ART

U.S. Pat. No. 5,514,637 relates to a typical thermal dye transfer process in which a set of three subtractive color image dyes are sequentially transferred to a receiver in order to obtain a full color image. This patent also described the use of a fourth protective layer patch on the dye-donor element for post-imaging transfer of a protective layer to seal in the dyes on the receiver for image stability. This protective layer patch is transferred over the entire image region.

It would be desirable to obtain a full color image using a smaller amount of dye-donor element in a shorter amount of time.

EP 433,024 and U.S. Pat. No. 4,791,095 relate to a heat-sensitive recording material containing a dye precursor or a leuco dye. There is a problem with using these dye precursors or leuco dyes in a recording element in that only one color can be obtained.

It is an object of this invention to provide an assemblage which can be used to obtain a full color image using a smaller amount of dye-donor element. It is another object of this invention to provide an assemblage which can be used to obtain a full color image having a protective overcoat in a shorter period of time.

SUMMARY OF THE INVENTION

These and other objects are achieved in accordance with this invention which relates to a thermal dye transfer assemblage comprising:

I) a dye-donor element comprising a support having thereon a set of sequential repeating dye patches of two subtractive primary color image dyes dispersed in a polymeric binder; and II) a dye-receiving element comprising a support having thereon in order:

a) a layer comprising a heat-sensitive, dye-forming precursor of a third, complementary, subtractive primary color image dye dispersed in a polymeric binder, the dye-forming precursor being capable of forming the third, complementary, subtractive primary color image dye at a temperature which is higher than the temperature used to transfer the other two subtractive primary color image dyes; and b) a dye image-receiving layer; the dye-receiving element being in superposed relationship with the dye-donor element so that the dye layer is in contact with the dye image-receiving layer.

Another embodiment of the invention relates to a process of forming a dye transfer image comprising:

I) imagewise-heating a dye-donor element comprising a support having thereon a set of sequential repeating dye patches of two subtractive primary color image dyes dispersed in a polymeric binder, and II) transferring a dye image to a dye-receiving element to form the dye transfer image, the dye-receiving element comprising a support having thereon in order:

a) a layer comprising a heat-sensitive, dye-forming precursor of a third, complementary, subtractive primary color image dye dispersed in a polymeric binder, the dye-forming precursor being capable of forming the third, complementary, subtractive primary color image dye at a temperature which is higher than the temperature used to transfer the other two subtractive primary color image dyes; and b) a dye image-receiving layer;

whereby, before or after transfer of the two subtractive primary color image dyes to the dye-receiving element, the layer comprising the heat-sensitive, dye-forming precursor of the third, complementary, subtractive primary color image dye is heated to a temperature sufficient to cause it to form the third, complementary, subtractive primary color.

DESCRIPTION OF THE PREFERRED EMBODIMENTS

According to the present invention, thermal dye transfer is used to transfer sublimative dyes of two colors from a dye-donor element to a dye-receiver element which has incorporated a heat-sensitive dye precursor, such as a leuco dye, of a third color. The transfer temperature of the maximum transferred density of the first two colors is below the temperature necessary to activate the dye-precursor in the dye-receiver element to form the third color.

During a third heating step, a thermal head, for example, heats the receiving element, or heats the dye-donor element through a clear patch, to cause imagewise color generation of the third color (from the dye precursor) within the dye-receiver element. It is also possible to heat fix or transfer a protective laminate material over the entire image area during this final step. A full-color image is thus generated with one less patch on the dye-donor element (and in the case of a protective layer transfer, one less required heating step). Extra thermal reaction time in all image areas can also be used to help complete any heat fixing of the thermally-transferred dyes. Finally, although described with the thermal dye transfer occurring first, any order of color production can be used.

When a protective layer is to be transferred non-imagewise, the heat used to cause the dye precursor to form a dye is greater than that necessary to transfer the protective layer. When generating an image using the dye precursor, the minimum temperature used will cause the protective layer to transfer non-imagewise, but not cause the dye-precursor to form unwanted dye.

In a preferred embodiment of the invention, the dye-donor element contains a third patch comprising a transparent polymeric layer, and when the third, complementary, subtractive primary color image dye is heated to a temperature sufficient to cause it to form the third, complementary, subtractive primary color, the same heat causes the transparent polymeric material to be transferred non-imagewise to the receiving layer.

The third patch of the dye-donor element employed in the invention can comprise any of the materials commonly used in the art, such as those disclosed in U.S. Pat. No. 5,514,637 discussed above, the disclosure of which is incorporated by reference. Examples of such materials include poly(vinyl benzal), poly(vinyl acetal), poly(vinyl formal), etc.

Heat-sensitive dye-precursors employed in the dye-receiving element of the invention can include those materials as disclosed in EP 433,024 and U.S. Pat. No. 4,791,095, the disclosures of which are hereby incorporated by reference. In a preferred embodiment of the invention, leuco dyes are employed. The dyes may also be encapsulated as disclosed in U.S. Pat. Nos. 5,216,438; 3,276,804; and 3,796,696, the disclosures of which are hereby incorporated by reference. Thermal developers, as disclosed in these patents, may also be used in the invention, if desired.

Any dye can be used in the dye-donor element employed in the invention provided it is transferable to the dye-receiving layer by the action of heat. Especially good results have been obtained with sublimable dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicaryl Blue 6G® (product of Sumitomo Chemical Co., Ltd.), and Aizen Malachite Green® (product of Hodogaya Chemical Co., Ltd.);

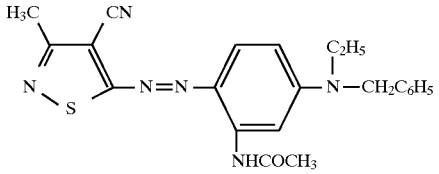

Magenta Dye M-1

-continued

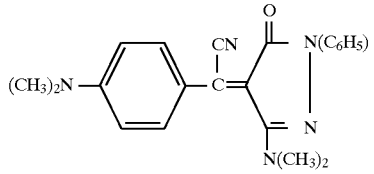

Magenta Dye M-2

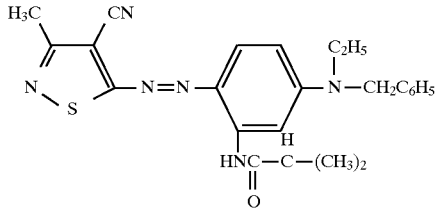

Magenta Dye M-3

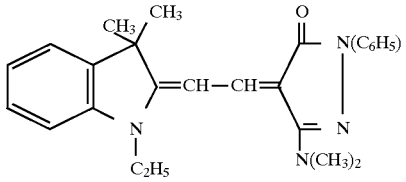

Yellow Dye Y-1

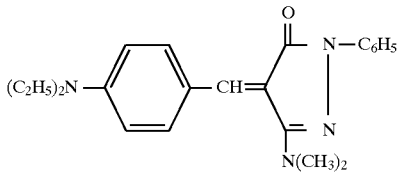

Yellow Dye Y-2

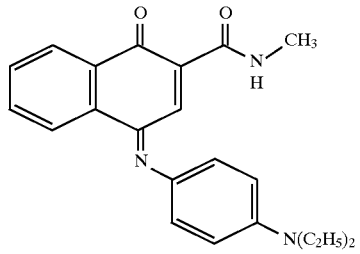

Cyan Dye C-1

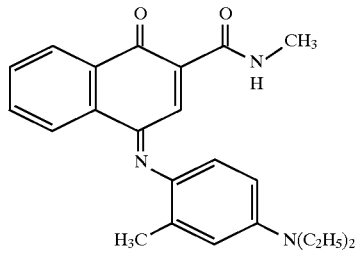

Cyan Dye C-2

-continued

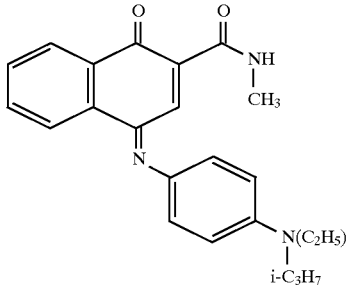

Cyan Dye C-3 or any of the dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. The above dyes may be employed singly or in combination. The dyes may be used at a coverage of from about 0.05 to about 1 g/m$^2$ and are preferably hydrophobic.

A dye-barrier layer may be employed in the dye-donor elements used in the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element used in the invention provided it is dimensionally stable and can withstand the heat of the thermal head. Such materials include polyesters such as poly(ethylene terephthalate); polyamides; polycarbonates; cellulose esters such as cellulose acetate; fluorine polymers such as poly (vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 3 to about 200 $\mu$m. It may also be coated with a subbing layer, if desired, such as those materials described in U. S. Patents 4,695,288 or 4,737,486.

The dye in the dye-donor element used in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; poly(vinyl acetate), poly(vinyl acetal), poly(vinyl butyral), poly(styrene-co-acrylonitrile), a polysulfone, a poly (phenylene oxide) or a phenoxy resin. The binder may be used at a coverage of from about 0.1 to about 5 g/m$^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface-active agent Preferred lubricating materials include oils or semicrystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U. S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used in the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper, a microvoided synthetic support as described in U.S. Pat. No. 5,244,861 or a synthetic paper such as DuPont Tyvek®. Pigmented supports such as white polyester (transparent polyester with white pigment incorporated therein) may also be used.

The dye image-receiving layer may comprise, for example, a polycarbonate, a polyurethane, a polyester, a polyacrylate, poly(vinyl chloride), poly(styrene-co-acrylonitrile), polycaprolactone, poly(vinyl acetal), poly (vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089, or a Rohm Thermal Head KE 2008-F3.

The following example is provided to illustrate the invention:

EXAMPLE

The following materials were used in the experimental work:

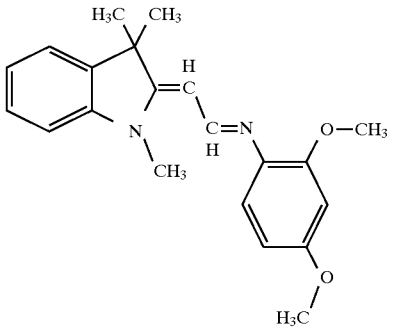

Yellow Dye

-continued

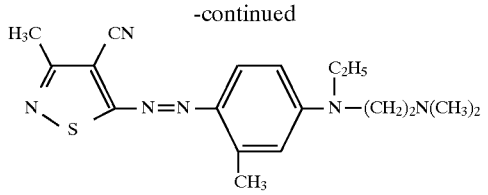

Magenta Dye

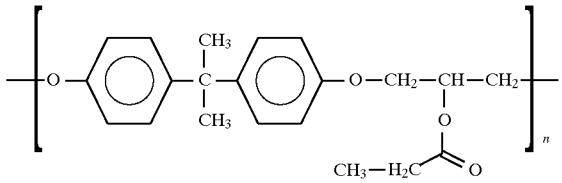

Propionated phenoxy resin

Receiving Element

Commercially available Fuji Thermal Autochrome® material as described in U.S. Pat. No. 5,216,438 was used to prepare a test receiver containing a cyan-forming leuco dye by exposure to 30 time units (~112 sec) of a NuArc Co. Model 26-1KS-NT Metal Halide Exposure System. This exposure destroyed the magenta and yellow layers on the Fuji Thermal Autochrome® material (as was verified by heating another sample on a hot plate to more than 150° C. to produce only cyan color.)

The above-exposed support containing a leuco cyan dye was coated with an adhesion-promoting layer of:

0.022 g/m$^2$ Polymin P® an aqueous polyethyleneimine solution available from BASF Corp.

followed by a dye image-receiving layer of:

2.37 g/m$^2$ AQ29H polyester ionomer available from Eastman Chemical Co., 3.46 g/m$^2$ copolymer of n-butyl acrylate, allyl methacrylate and glycidyl methacrylate (92:2:10), and 0.097 g/m$^2$ succinic acid.

Dye-Donor Elements

A yellow dye-donor element was prepared by coating on 6 $\mu$m poly(ethylene terephthalate) support the following layers:

1) a subbing layer of Tyzor TBT®, a titanium tetrabutoxide, (DuPont Company) (0.12 g/m$^2$ ) coated from a 15:85 wt-% blend of 1-butanol and propyl acetate; and 2) a dye layer containing the yellow dye described above (0.280 g/m$^2$), a fluoroalkyl acrylate copolymer of butyl methacrylate and DuPont Zonylo fluorochemical 75/25 wt. % , (0.051 g/m$^2$), and the propionated phenoxy resin described above (0.291g/m$^2$) coated from a 65:30:5 wt-% toluene/n-propanoycyclohexanone mixture.

A magenta dye-donor element was prepared by coating on 6 $\mu$m poly(ethylene terephthalate) support the following layers:

1) a subbing layer of TyzorTBT®, a titanium tetrabutoxide, (DuPont Company) (0.13 g/m$^2$) coated from a 15:85 wt-% blend of 1-butanol and propyl acetate; and 2) a dye layer containing the magenta dye described above (0.205g/m), a fluoroalkyl acrylate copolymer of butyl methacrylate and DuPont Zonyl® fluorochemical 75/25 wt. %, (0.033 g/m$^2$), and the propionated phenoxy resin described above (0.188 g/m$^2$) coated from a 65:30:5 wt-% toluene/n-propanoYcyclohexanone mixture.

On the backside of each dye-donor element were coated:

1) a subbing layer of Tyzor TBT®, (0.13 g/m$^2$) coated from a 15:85 wt-% blend of 1-butanol and propyl acetate, and 2) a slipping layer of poly(vinyl acetal) (Sekisui Kagaku KK) (0.38 g/m$^2$), a Candelilla wax dispersion (7% in methanol) (0.022 g/m$^2$), PS513, an amino-terminated polydimethyl-siloxane, (Huels) (0.011 g/m$^2$), and p-toluenesulfonic acid (0.0003 g/m$^2$) coated from a 98:2 wt-% 3-pentanonel-distilled water mixture.

Preparation of Thermal Dye Transfer Images

For the thermal printing, a prototype printer was used equipped with a thermal head, a drum platen, a power supply, and head drive electronics. The thermal head consisted of an array of resistive heaters on a ceramic substrate with a pitch of 5.4 dots/mm and an average resistance of 500 ohms per heater. The head pressure against the media was 0.31 kg/cm of print head. The head modulation was of the pulse-count type which consisted of 0–255 heat pulses per heater per print line, while the time to print one image line was 17 Ms. A Kepco power supply Model ATE75-15M provided a drive voltage for the print head. Head control data signals were generated by an IBM AT personal computer equipped with custom timing boards.

A yellow dye-donor element was placed in face-to-face contact with the above described receiver material and a series of patches of varying density were written using the prototype printer. To print the highest density, an energy corresponding to 8 J/cm$^2$ was applied to the print head. The yellow dye-donor element was separated from the dye-receiver element, and the printing was repeated using a magenta dye-donor element.

Finally, a clear piece of uncoated donor element was brought into face-to-face contact and the last set of density images written. In this case, the printing energy corresponding to maximum density was increased to 19 J/cm$^2$, while the energy to print the minimum density (no printing) was 7.7 J/cm$^2$. The minimum energy was near the maximum for the previous two dye-donors to allow complete conversion of any partially reacted dyes.

The color densities of the resulting image densities were measured using an X-Rite 938® Spectrophotometer with a $D_{50}{}^2$ light source and Status A filtration. The data are shown in the Table below:

TABLE

| Power (J/cm$^2$) | Status A Red (cyan) OD | Status A Green (magenta) OD | Status A Blue (yellow) OD |
|---|---|---|---|
| 0.8 | <0.11 | 0.15 | 0.16 |
| 1.6 | <0.11 | 0.18 | 0.18 |
| 2.4 | <0.11 | 0.26 | 0.22 |
| 3.2 | <0.11 | 0.41 | 0.35 |
| 4.0 | <0.11 | 0.62 | 0.54 |
| 4.9 | <0.11 | 0.89 | 0.79 |
| 5.7 | <0.11 | 1.21 | 1.14 |
| 6.5 | <0.11 | 1.57 | 1.46 |
| 7.3 | <0.11 | 1.90 | 1.73 |
| 8.1 | <0.11 | 2.24 | 1.94 |
| 8.9 | 0.11 | nm | nm |

TABLE-continued

| Power (J/cm$^2$) | Status A Red (cyan) OD | Status A Green (magenta) OD | Status A Blue (yellow) OD |
|---|---|---|---|
| 10.1 | 0.12 | nm | nm |
| 11.3 | 0.13 | nm | nm |
| 12.4 | 0.16 | nm | nm |
| 13.7 | 0.28 | nm | nm |
| 14.8 | 0.51 | nm | nm |
| 16.1 | 0.81 | nm | nm |
| 17.2 | 1.10 | nm | nm |
| 18.4 | 1.23 | nm | nm |
| 19.6 | 1.29 | nm | nm |

nm = not measured

The above results show that adequate density was obtained for all three colors (1.29 for cyan at 19.6 J/cm$^2$, 2.24 for magenta at 8.1 J/cm$^2$, and 1.94 for yellow at 8.1 J/cm$^2$). At 8.1 J/cm$^2$, little of the cyan leuco dye had been converted. However, the magenta and yellow dye had good density at that power level. At the higher power levels (e.g., 19.6 J/cm$^2$), cyan dye was formed with good density.

The invention has been described in detail with particular reference to preferred embodiments thereof, but it will be understood that variations and modifications can be effected within the spirit and scope of the invention.

What is claimed is:

1. A thermal dye transfer assemblage comprising:

I) a dye-donor element comprising a support having thereon a set of sequential repeating dye patches of two subtractive primary color image dyes dispersed in a polymeric binder; and II) a dye-receiving element comprising a support having thereon in order:

a) a layer comprising a heat-sensitive, dye-forming precursor of a third, complementary, subtractive primary color image dye dispersed in a polymeric binder, said dye-forming precursor being capable of forming said third, complementary, subtractive primary color image dye at a temperature which is higher than the temperature used to transfer said other two subtractive primary color image dyes; and b) a dye image-receiving layer;

said dye-receiving element being in superposed relationship with said dye-donor element so that said dye layer is in contact with said dye image-receiving layer.

2. The assemblage of claim 1 wherein said dye-donor element contains a third patch comprising a transparent polymeric layer.

3. The assemblage of claim 1 wherein said heat-sensitive, dye-forming precursor is a leuco dye.

4. The assemblage of claim 3 wherein said leuco dye forms a cyan dye after being heated to a temperature which is higher than the temperature used to transfer said other two subtractive primary color image dyes.

5. The assemblage of claim 3 wherein said leuco dye is encapsulated.

6. A process of forming a dye transfer image comprising:

I) imagewise-heating a dye-donor element comprising a support having thereon a set of sequential repeating dye patches of two subtractive primary color image dyes dispersed in a polymeric binder, and II) transferring a dye image to a dye-receiving element to form said dye transfer image, said dye-receiving element comprising a support having thereon in order:

a) a layer comprising a heat-sensitive, dye-forming precursor of a third, complementary, subtractive primary color image dye dispersed in a polymeric binder, said dye-forming precursor being capable of forming said third, complementary, subtractive primary color image dye at a temperature which is higher than the temperature used to transfer said other two subtractive primary color image dyes; and b) a dye image-receiving layer;

whereby, before or after transfer of said two subtractive primary color image dyes to said dye-receiving element, said layer comprising said heat-sensitive, dye-forming precursor of said third, complementary, subtractive primary color image dye is heated to a temperature sufficient to cause it to form said third, complementary, subtractive primary color.

7. The process of claim 6 wherein said dye-donor element contains a third patch comprising a transparent polymeric layer, and when said third, complementary, subtractive primary color image dye is heated to a temperature sufficient to cause it to form said third, complementary, subtractive primary color, the same heat causes said transparent polymeric material to be transferred non- imagewise to said receiving layer.

8. The process of claim 6 wherein said heat-sensitive, dye-forming precursor is a leuco dye.

9. The process of claim 8 wherein said leuco dye forms a cyan dye after being heated to a temperature which is higher than the temperature used to transfer said other two subtractive primary color image dyes.

10. The process of claim 8 wherein said leuco dye is encapsulated.

11. The process of claim 6 wherein a thermal head is used for said heating.

* * * * *